US006688370B1

(12) United States Patent
Nien

(10) Patent No.: US 6,688,370 B1
(45) Date of Patent: Feb. 10, 2004

(54) LIGHT CONTROL WINDOW COVERING ASSEMBLY

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/331,538

(22) Filed: Dec. 31, 2002

(30) Foreign Application Priority Data

Sep. 25, 2002 (TW) ..... 91215151 U

(51) Int. Cl.[7] ..... E06B 9/08
(52) U.S. Cl. ..... 160/121.1; 160/84.05
(58) Field of Search ..... 160/121.1, 84.04, 160/84.05, 84.06, 89, 236, 264

(56) References Cited

U.S. PATENT DOCUMENTS 3,384,519 A * 5/1968 Froget ..... 160/84.05
4,934,435 A * 6/1990 Regev ..... 160/84.04
5,394,922 A * 3/1995 Colson et al. ..... 160/121.1
6,164,363 A * 12/2000 Colson et al. ..... 160/84.05
6,302,982 B1 * 10/2001 Corey et al. ..... 160/84.04
6,502,619 B1 * 1/2003 Kraeutler ..... 160/84.04

* cited by examiner

*Primary Examiner*—David Purol
(74) *Attorney, Agent, or Firm*—Bacon & Thomas, PLLC

(57) ABSTRACT

A light control window covering assembly is constructed to include a translucent fabric sheet, a set of opaque vanes each having a first end portion respectively fixedly fastened to the fabric sheet at different elevations and a second end provided with a sleeve having two cut holes near the two distal ends, a connecting member formed of a sheet of fabric material and arranged in parallel to the fabric sheet, and a plurality of connecting rods. The connecting member has vertically spaced pairs of wire loops respectively engaged into the cut holes of the sleeves of the vanes. The connecting rods respectively inserted into the wire loops of the connecting member and the sleeves of the vanes to secure the second end portions of the vanes to the connecting member at different elevations.

12 Claims, 15 Drawing Sheets

LIGHT CONTROL WINDOW COVERING ASSEMBLY

BACKGROUND OF THE INVENTION

1. Field of the Invention

The present invention relates to window coverings and, more particularly, to a light control window covering assembly.

2. Description of the Related Art

A light control window covering, for example, the disclosure of U.S. Pat. No. 3,384,519, as shown in FIG. 1, comprises a first translucent fabric sheet 1, a second translucent fabric sheet 2, and a plurality of slats 3 fixedly connected in parallel between the first translucent fabric sheet 1 and the second translucent fabric sheets 2 subject to a predetermined interval. Relative displacement between the first semi-transparent fabric sheet 1 and the second translucent fabric sheet 2 tilts the slats 3 to regulate light passing through the fabric sheets 1 and 2. In comparison with conventional Venetian blinds, this structure of light control window covering has a softer appearance and provides a better visual insulating effect. Therefore, this kind of light control window covering stands high in consumers' favor.

U.S. Pat. Nos. 6,302,982; 6,164,363; 5,394,922; 5,313,999 disclose different light control window coverings. These designs commonly use two translucent or transparent fabric sheets to join opaque vanes. The only difference among these designs is their fabric sheets and vanes bonding structure. According to these conventional designs, the fabric sheets and the vanes are not detachable. Because the fabric sheets and the vanes are not detachable, it is difficult to clean these designs of light control window covering thoroughly. When cleaning a big size light control window covering with a cleaning apparatus, the cleaning apparatus may be not accessible to the deep inside of the light control window covering.

According to the aforesaid conventional designs, the end portions of the flexible vanes tend to fall or to be curved by external force because they are not connected to other bodies. The falling or curving of the end portions of the vanes destroys the sense of beauty of the whole assembly. In order to eliminate this drawback, the major part or the whole of the end portions of the vanes must be fastened to the two fabric sheets, causing the fabric sheets to be overlapped. In consequence, the see-through quality of the window covering is poor.

Therefore, it is desirable to have a light control window covering assembly that eliminates the drawbacks of the aforesaid prior art designs.

SUMMARY OF THE INVENTION

The present invention has been accomplished under the circumstances in view. It is the main object of the present invention to provide a light control window covering assembly, which is detachable for convenient cleaning.

It is another object of the present invention to provide a light control window covering assembly, which provides a good see-through quality.

To achieve these objects of the present invention, the light control window covering assembly comprises a fabric sheet made of translucent material, a set of vanes made of opaque material, at least one connecting member arranged in parallel to the fabric sheet, and a plurality of connecting rods. The vanes each has a first end portion connected to the fabric sheet at different elevations, and a second end portion providing with at least one first sleeve means each defining a first sleeve hole. The connecting member has a plurality of vertically spaced second sleeve means each defining a second sleeve hole corresponding in location to the first sleeve hole. The connecting rods are respectively inserted into the second sleeve holes of the second sleeve means of the connecting member and the first sleeve holes of the first sleeve means of the vanes to secure the vanes to the connecting member at different elevations.

DETAILED DESCRIPTION OF THE INVENTION

Figure 1:
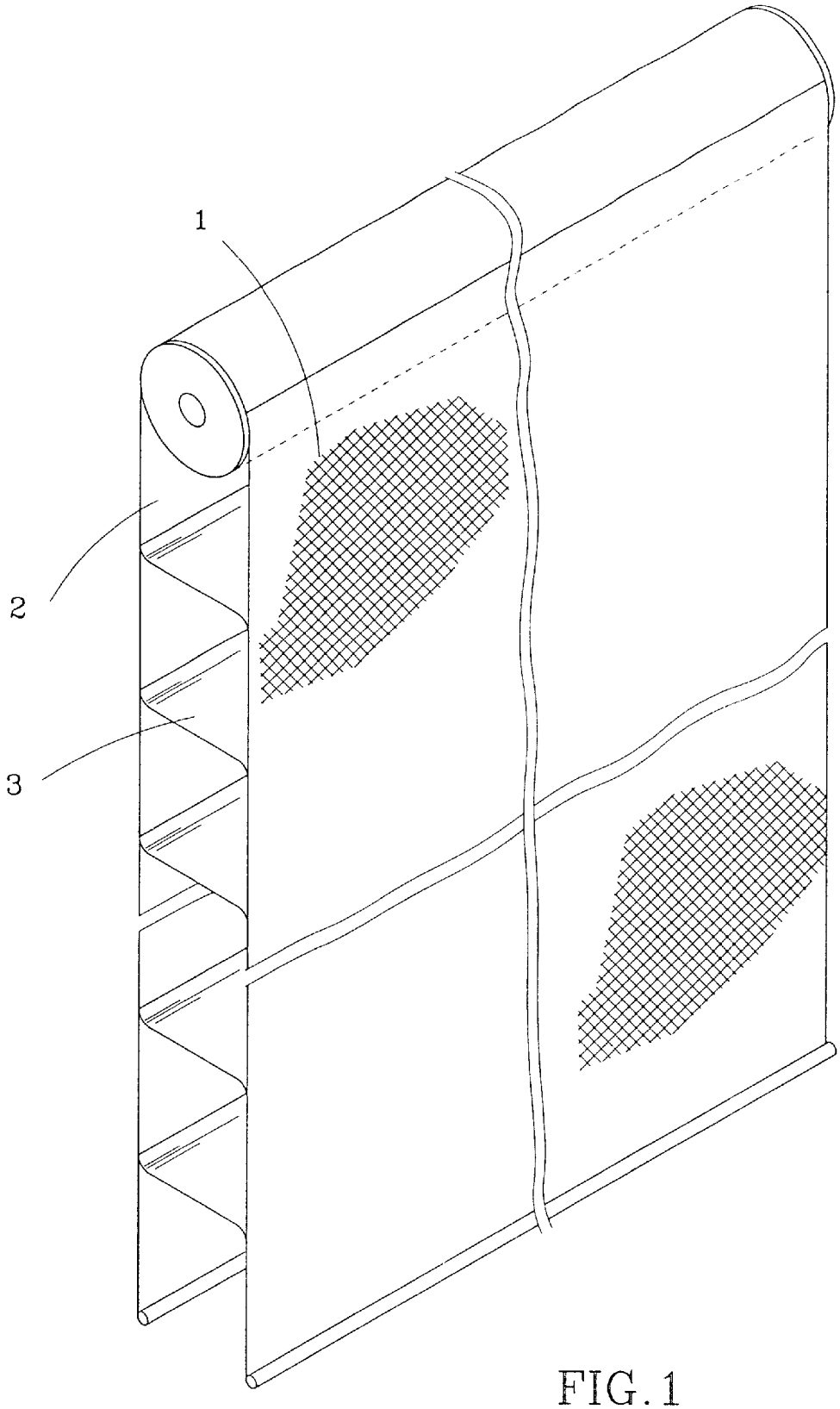
FIG. 1 PRIOR ART
FIG. 1 is perspective view of a light control window covering according to the prior art.
Figure 2:
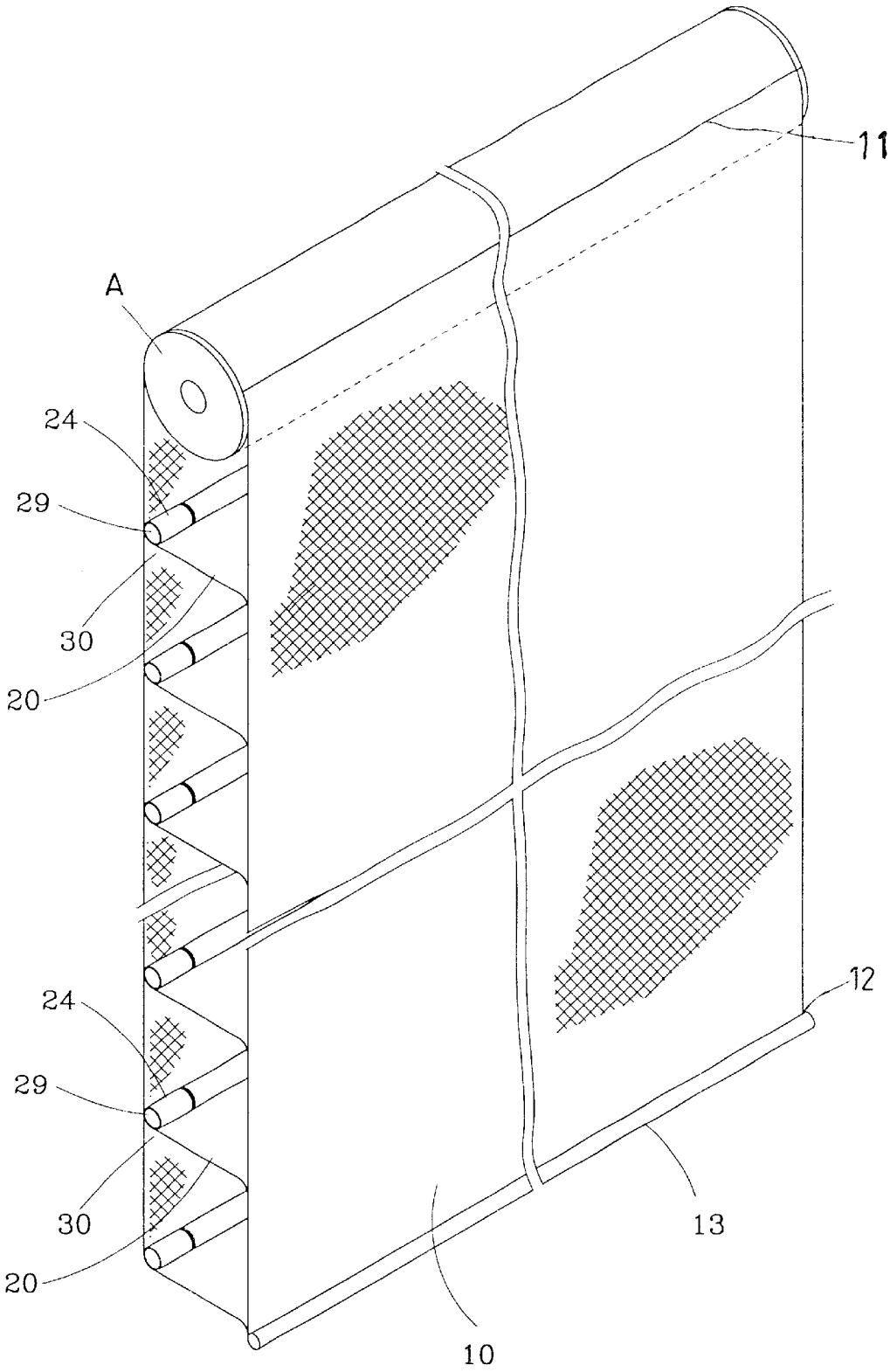
FIG. 2 is a perspective view of a light control window covering assembly according to a first embodiment of the present invention.
Figure 3:
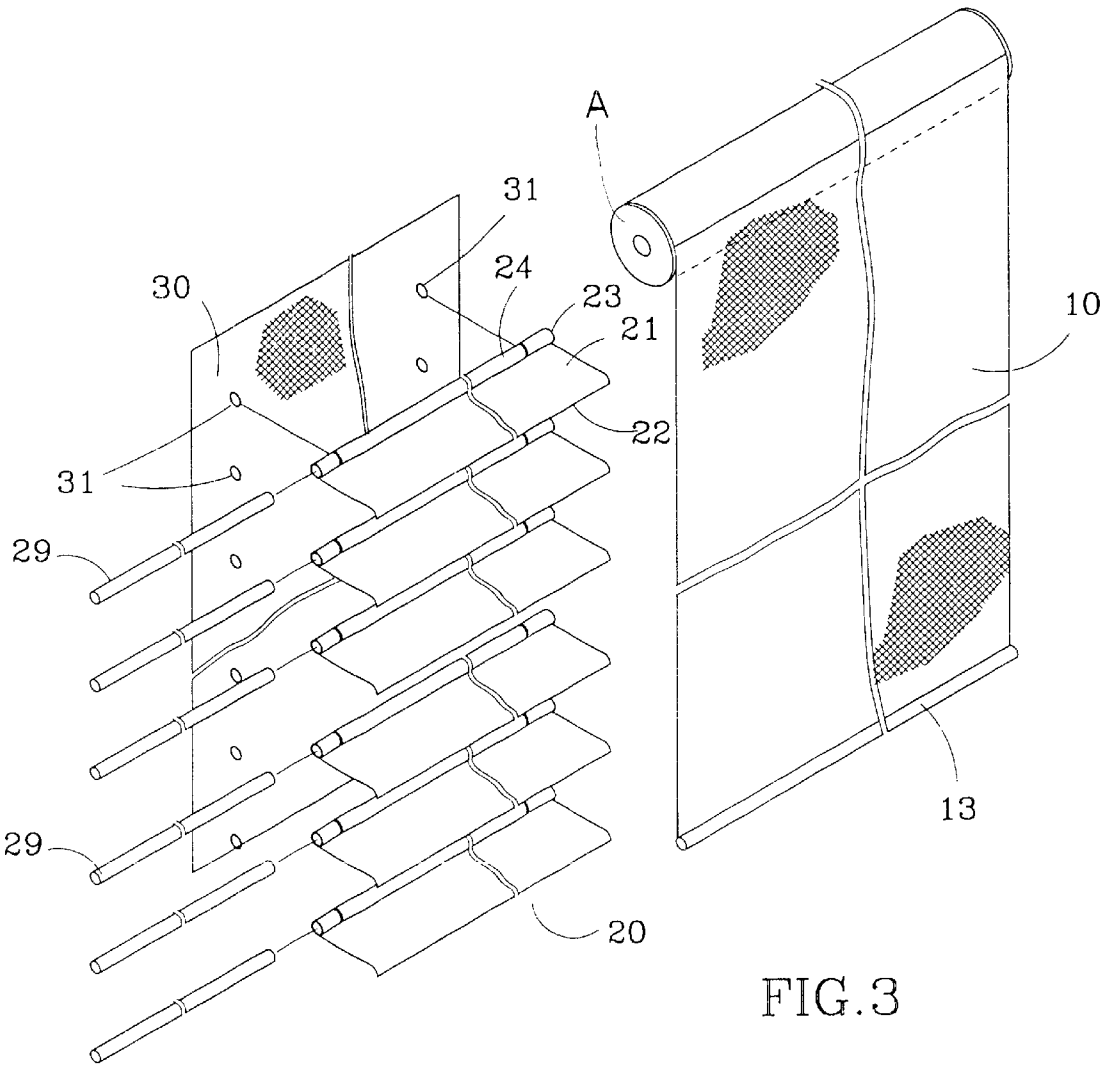
FIG. 3 is an exploded view of the light control window covering assembly according to the first embodiment of the present invention.
Figure 4:
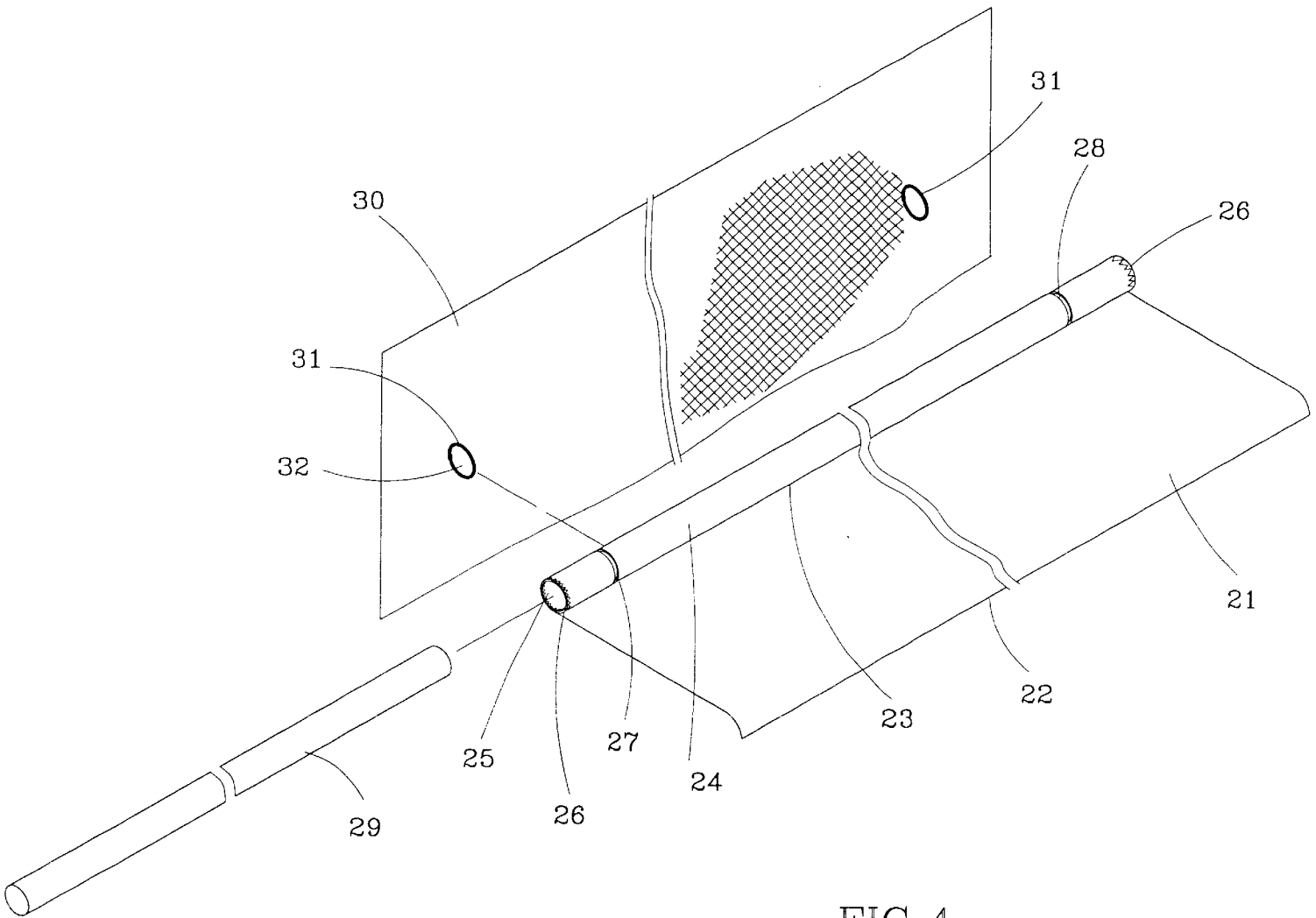
FIG. 4 is an exploded view in an enlarged scale of a part of the first embodiment of the present invention.

Referring to FIGS. 2~4, a light control window covering assembly in accordance with the first embodiment of the present invention is shown comprised of a fabric sheet 10, a set of vanes 20, a connecting member 30, and a plurality of connecting rods 29.

The fabric sheet 10 is a piece of translucent fabric having a predetermined length, a top end 11 fixedly fastened to a roller A, a bottom end 12, and a weight (heavy slat) 13 transversely fastened to the bottom end 12. The length of the weight 13 is equal to the width of the fabric sheet 10. The weight 13 imparts a downward tension to the fabric sheet 10, keeping the fabric sheet 10 smoothly extended out.

The vanes 20 each have a long, narrow vane body 21 on the middle, and a first end portion 22 and a second end portion 23 at two sides of the vane body 21. The vane body 21 is formed of opaque fabric or thin sheet of plastics. The first end portions 22 of the vanes 20 are respectively transversely fastened to the fabric sheet 10 subject to a predetermined pitch. Hot press, high-frequency heat sealing, glue, or stitches subject to the natures of the materials of the vanes 20 and the fabric sheet 10 can achieve the connection between the vanes 20 and the fabric sheet 10. The second end 23 of each vane 20 is provided with a first sleeve means which is a sleeve 24 in this embodiment by rolling up and stitching the second end. The first sleeve means, e.g. sleeve 24, defines a first sleeve hole, e.g. sleeve hole 25 in this embodiment. Two elastic bands 26 are fixedly fastened to the two distal ends of the sleeve 24 around the sleeve hole 25. Further, the sleeve 24 has two cut holes 27 and 28 near the two distal ends.

The connecting member 30 is made of a translucent fabric sheet having a length corresponding to the fabric sheet 10, and the top end fixedly fastened to the roller A. The connecting member 30 is maintained in parallel to the fabric sheet 10, having pairs of second sleeve means, for example, wire loops 31 provided at different elevations corresponding to the cut holes 27 and 28 of the sleeves 24 of the second end portions 23 of the vanes 20. The second sleeve means each define a second sleeve hole, e.g. loop hole 32 in this embodiment. The wire loops 31 of the connecting member 30 are respectively inserted into the cut holes 27 and 28 of the sleeves 24 of the second end portions 23 of the vanes 20, keeping the loop holes 32 of the wire loops 31 in axial alignment with the respective sleeve holes 25 of the sleeves 24 of the vanes 20.

The connecting rods 29 are glass fiber rods, wooden rods, or bamboo rods approximately equal to the length of the second end portions 23 of the vanes 20. The connecting rods 29 are respectively inserted through the loop holes 32 of the wire loops 31 of the connecting member 30 and the sleeve holes 25 of the sleeves 24 of the vanes 20 to secure the connecting member 30 to the second end portions 23 of the vanes 20. After insertion of the connecting rods 29 into the respective sleeves 24, the elastic bands 26 secure the connecting rods 29 to the sleeves 24 in position.

Figure 5:
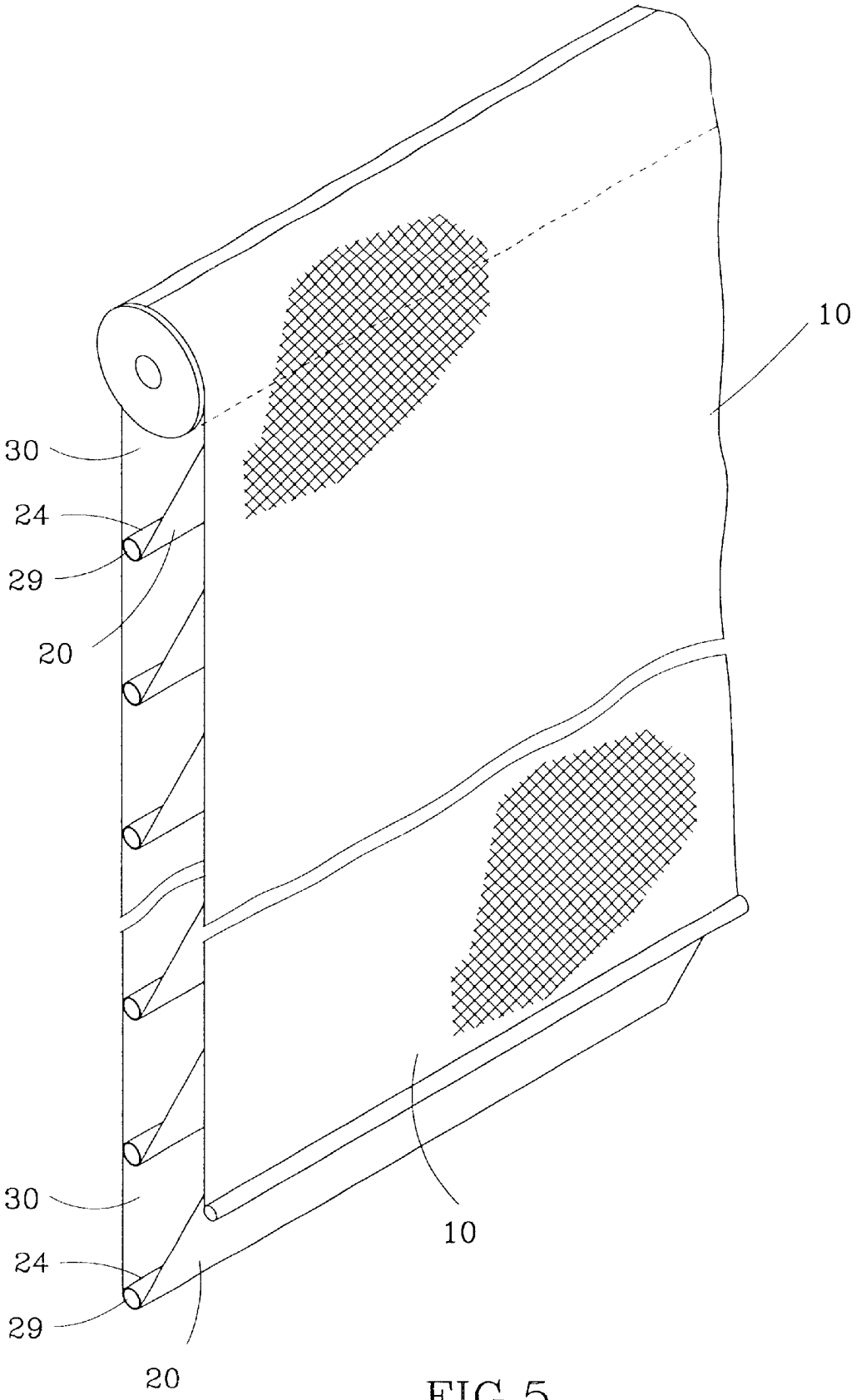
FIG. 5 is an operational view of the first embodiment of the present invention, showing the light control window covering assembly turned to off-position.

When the light control window covering assembly turned to on-position as shown in FIG. 2, the vanes 20 are maintained perpendicular to the fabric sheet 10 and the connecting member 30, and the user can see through the light control window covering assembly. When the light control window covering assembly turned to off-position as shown in FIG. 5, the relative position between the fabric sheet 10 and the connecting member 30 is changed, and the vanes 20 are tilted to shade the translucent area of the fabric sheet 10.

When the vanes 20 covered with external bodies, dust, dead vermin after a long use of the light control window covering assembly, the user can remove the connecting rods 29 from the sleeves 24 of the vanes 20 and the wire loops 31 of the connecting member 30 and then separate the connecting member 30 from the vanes 20, for enabling the vanes 20 to be well cleaned. After removal of the connecting member 30 from the vanes 20, the first end portions 22 of the vanes 20 are still maintained fixedly connected to the fabric sheet 10, and the send end portions 23 are freely suspended from the vanes 20 in the open air. The user can then clean the top and bottom sides of each vane 20 as well as the inner side of fabric sheet 10 and the connecting member 30. After cleaning, the connecting rods 29 are set in the sleeves 24 of the vanes 20 and the wire loops 31 of the connecting member 30 to secure the connecting member 30 to the vanes 20.

Figure 6:
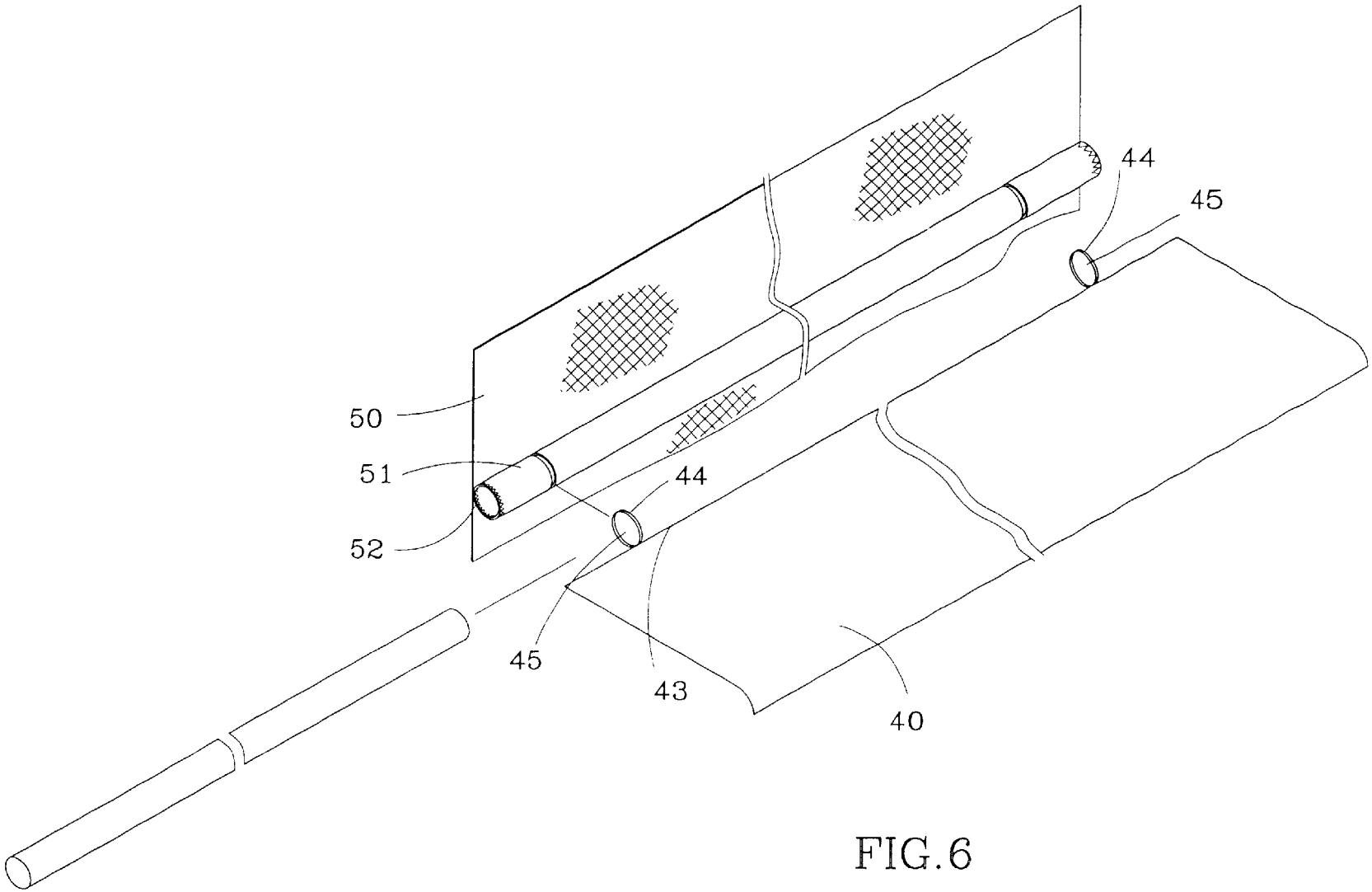
FIG. 6 is an exploded view in an enlarged scale of a part of a second embodiment of the present invention.

FIG. 6 is an exploded view of a part of the second preferred embodiment of the present invention. According to this embodiment, each vane 40 has two first sleeve means, e.g. wire loops 44 in this embodiment, bilaterally provided at the second end portion 43, each first sleeve means, i.e. wire loop 44, defining a first sleeve hole, i.e. a loop hole 45 in this embodiment; the connecting member 50 has a plurality of transversely extended second sleeve means, i.e. sleeves 51 in this embodiment, disposed at different elevations (only one sleeve is shown in FIG. 6), each sleeve 51 defining a second sleeve hole 52 for connection to the wire loops 44 of the corresponding vane 40.

Figure 7:
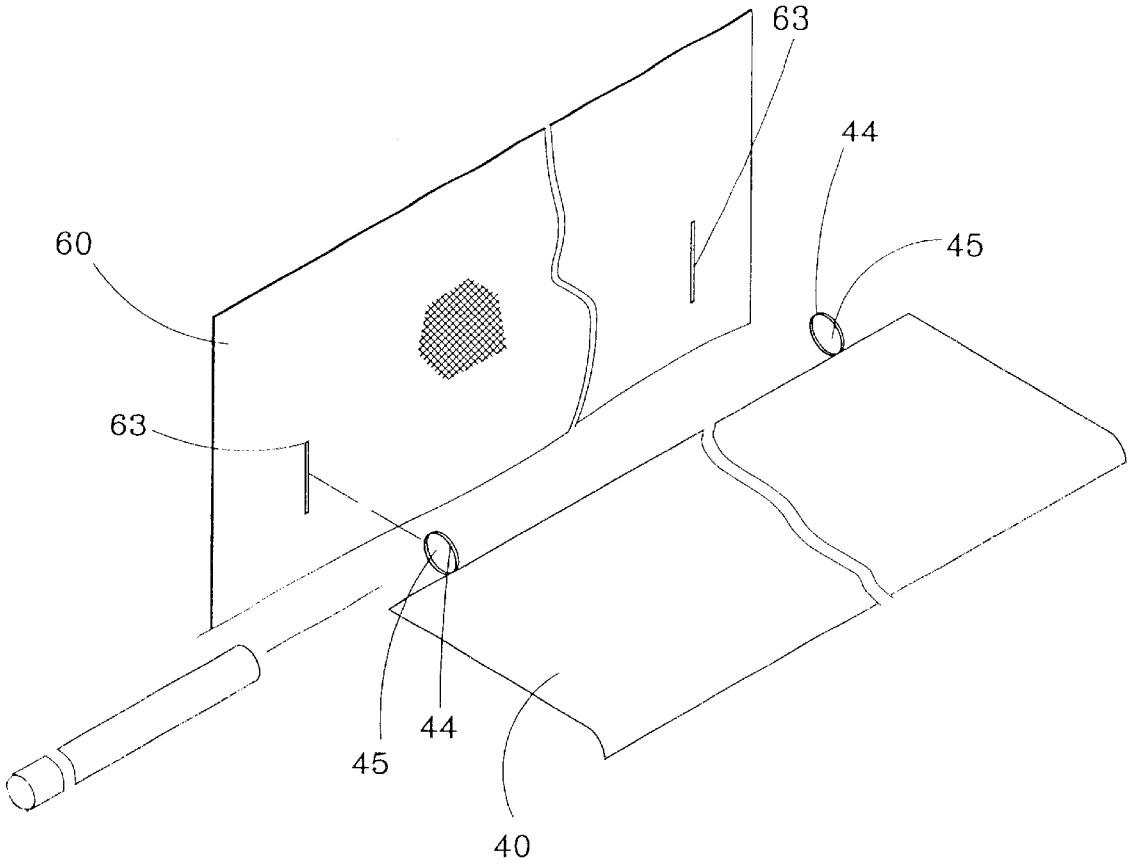
FIG. 7 is an exploded view in an enlarge scale of a part of a third embodiment of the present invention.
Figure 8:
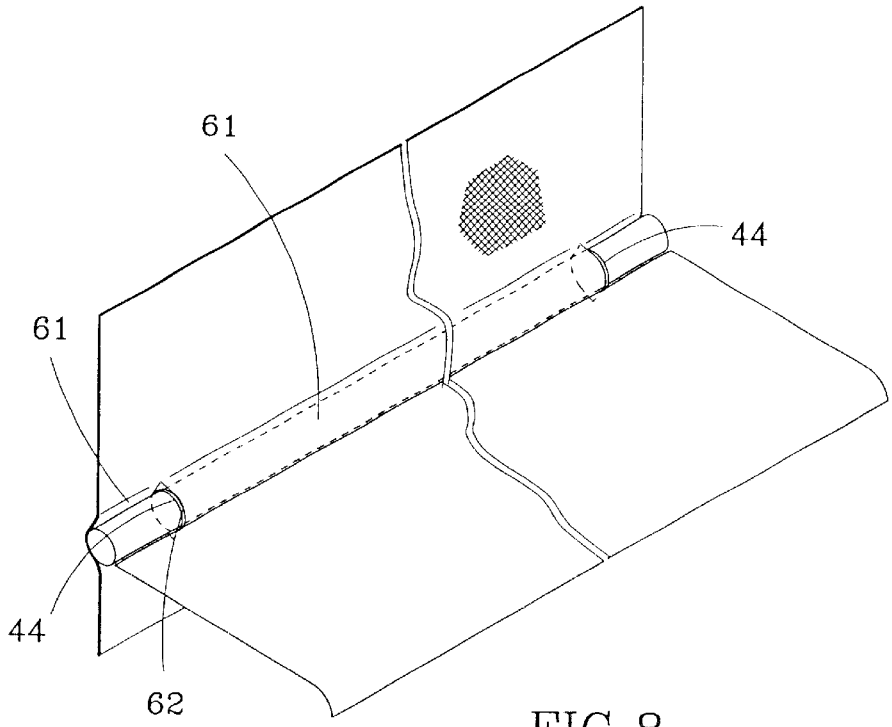
FIG. 8 is a perspective assembly view of FIG. 7.
Figure 9:
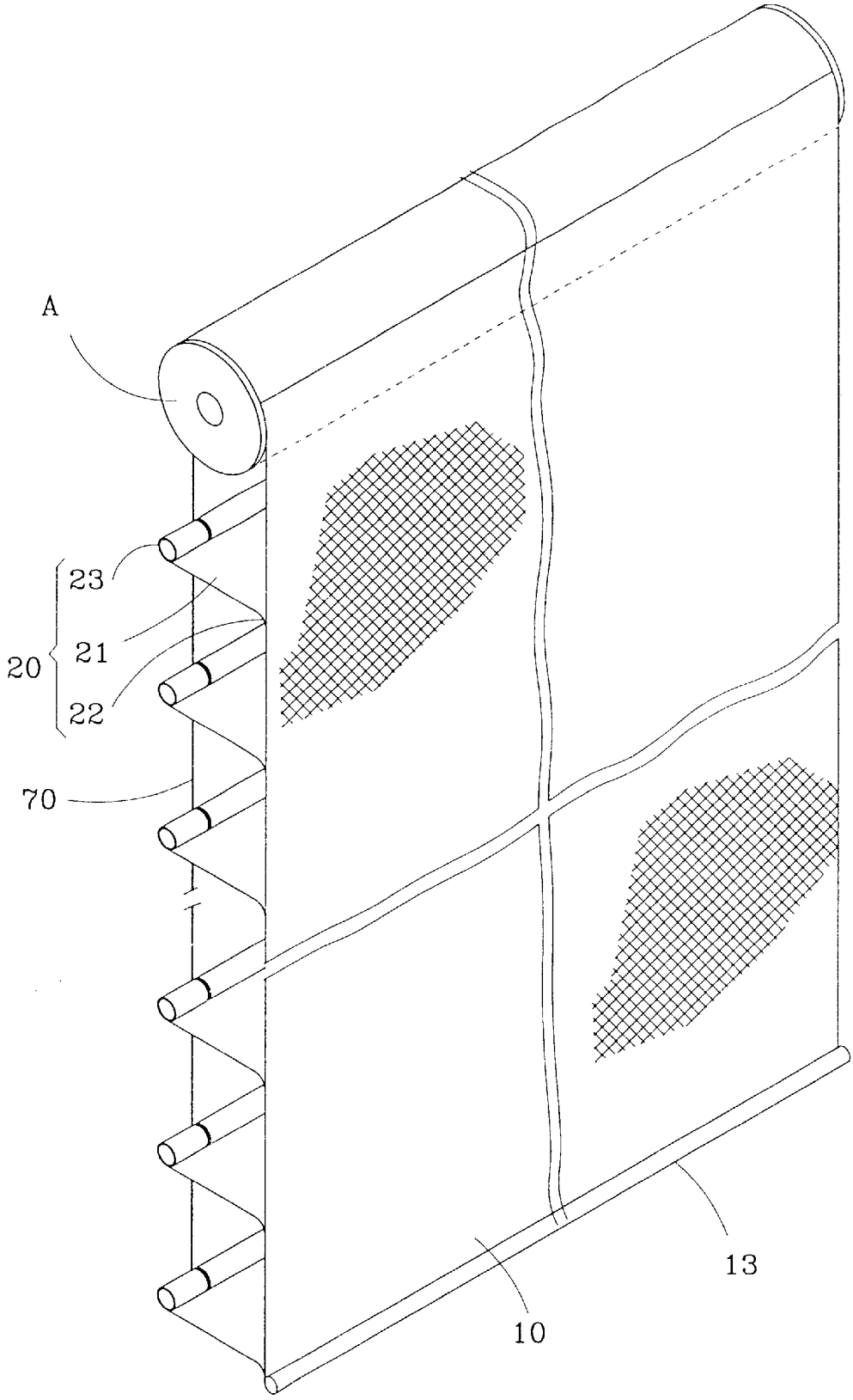
FIG. 9 is a perspective view of a fourth embodiment of the present invention, showing the light control window covering assembly turned to on-position.
Figure 10:
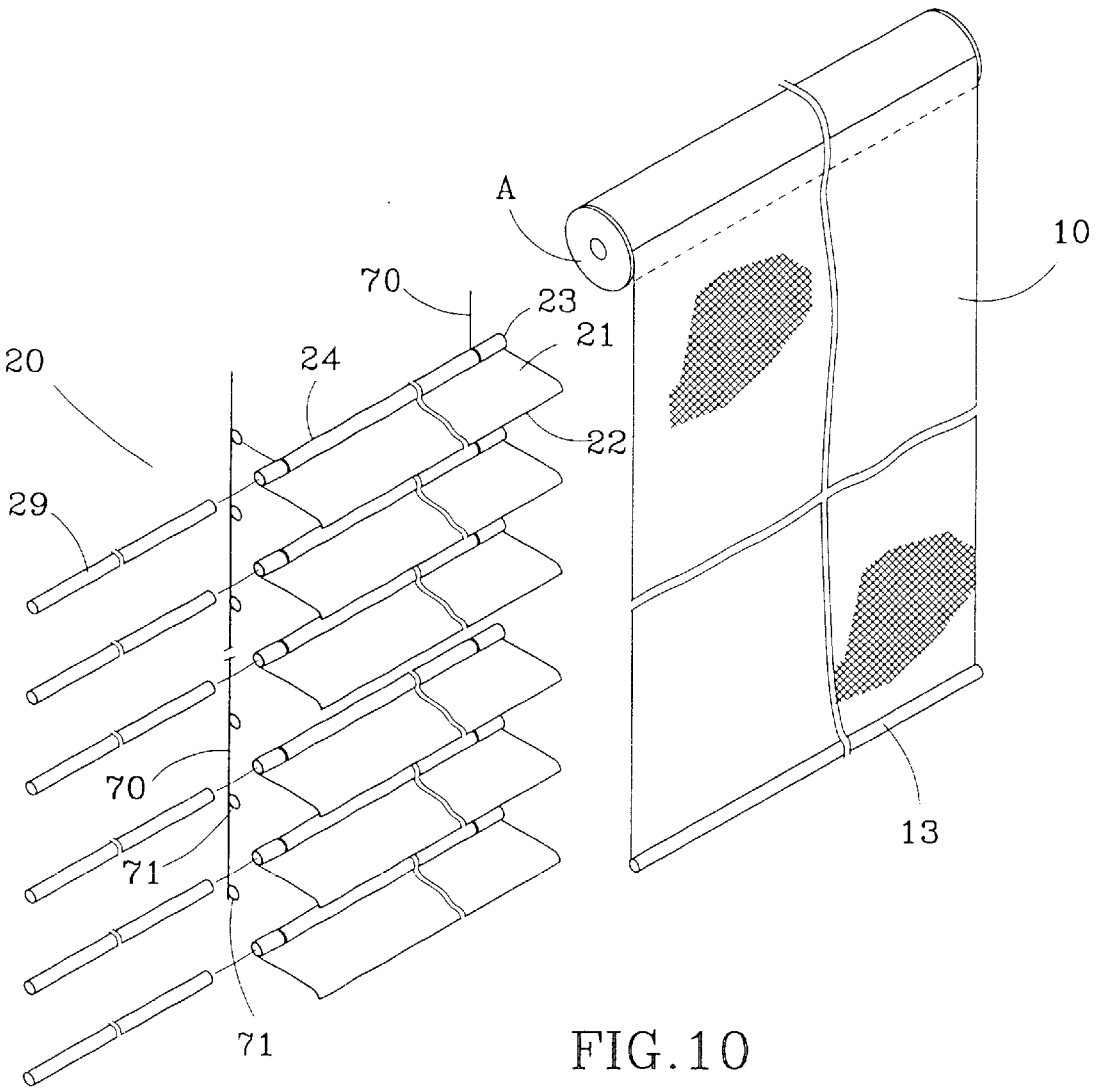
FIG. 10 is an exploded view of the, fourth embodiment of the present invention.
Figure 11:
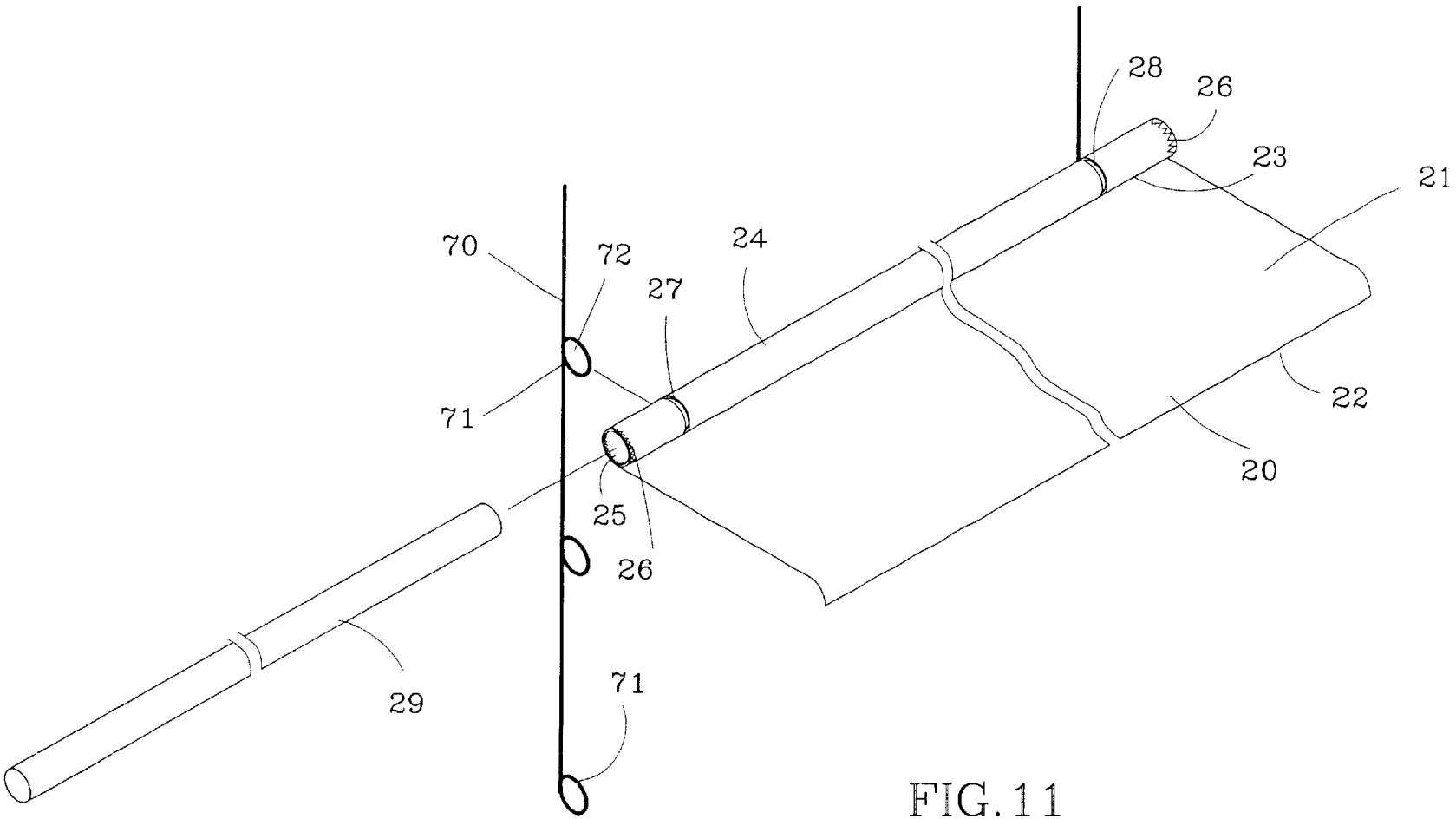
FIG. 11 is an exploded view in an enlarged scale of a part of the fourth embodiment of the present invention.
Figure 12:
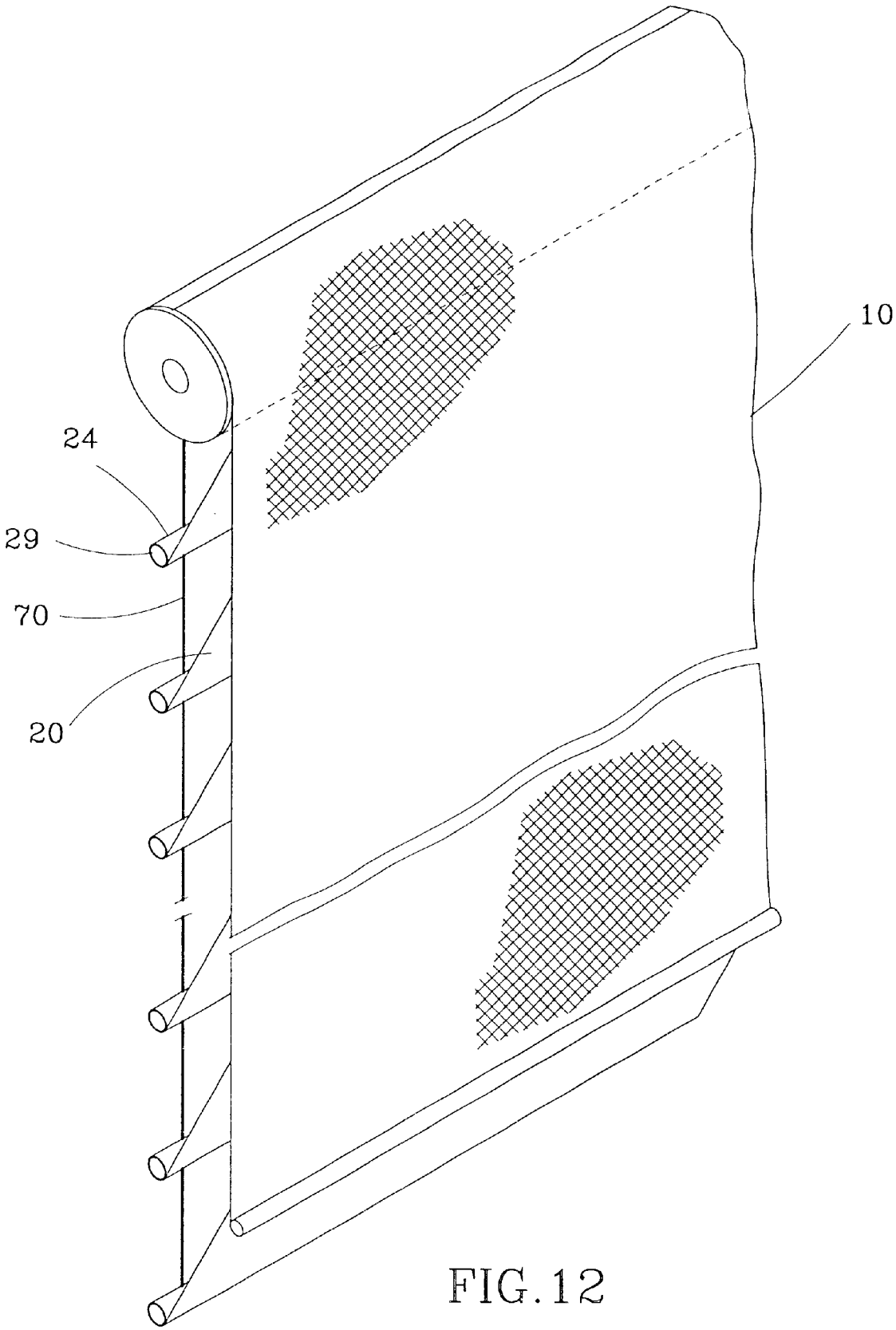
FIG. 12 is a perspective view of the fourth embodiment of the present invention showing the light control window covering assembly turned to off-position.

FIGS. 7 and 8 show a part of the third preferred embodiment of the present invention. According to this embodiment, each vane each vane 40 has two wire loops 44 bilaterally provided at the second end portion, each wire loop 44 defining a loop hole 45; the connecting member 60 has pairs of longitudinal cut holes 63 corresponding to the wire loops 44 of the vanes 40, each pair of cut holes 63 defining with a part of the body of the connecting member 60 a transversely extended open sleeve 61 having a sleeve hole 62 for connection to the wire loops 44 of the corresponding vane 40 by a connecting rod 29.

FIGS. 9~12 show the fourth preferred embodiment of the present invention. This embodiment is similar to the aforesaid first embodiment with the exception of the arrangement of two cord-like connecting members instead of one fabric sheet type connecting member. As illustrated, two cord-like connecting members 70 are bilaterally suspended from the roller A, each having a plurality of second sleeve means, i.e. wire loops 71 in this embodiment, disposed at different elevations for connection to the sleeves 24 at the second end portions 23 of the vanes 20 by connecting rods 29. The connecting rods 29 work as stiffeners for the second end portions 23 of the vanes 20 to enhance the toughness of the second end portions 23 of the vanes 20. The cord-like connecting members 70 can be respectively formed of one single string. Alternatively, the cord-like connecting members 70 can be formed of twisted strands. Because only one sheet of fabric material (the fabric sheet 10) is used, the light control window covering assembly provides a relatively better see-through quality. Further, because the second end portions 23 of the vanes 20 are respectively supported on the hard connecting rods 29, the second end portions 23 of the vanes 20 do not fall or curve.

Figure 13:
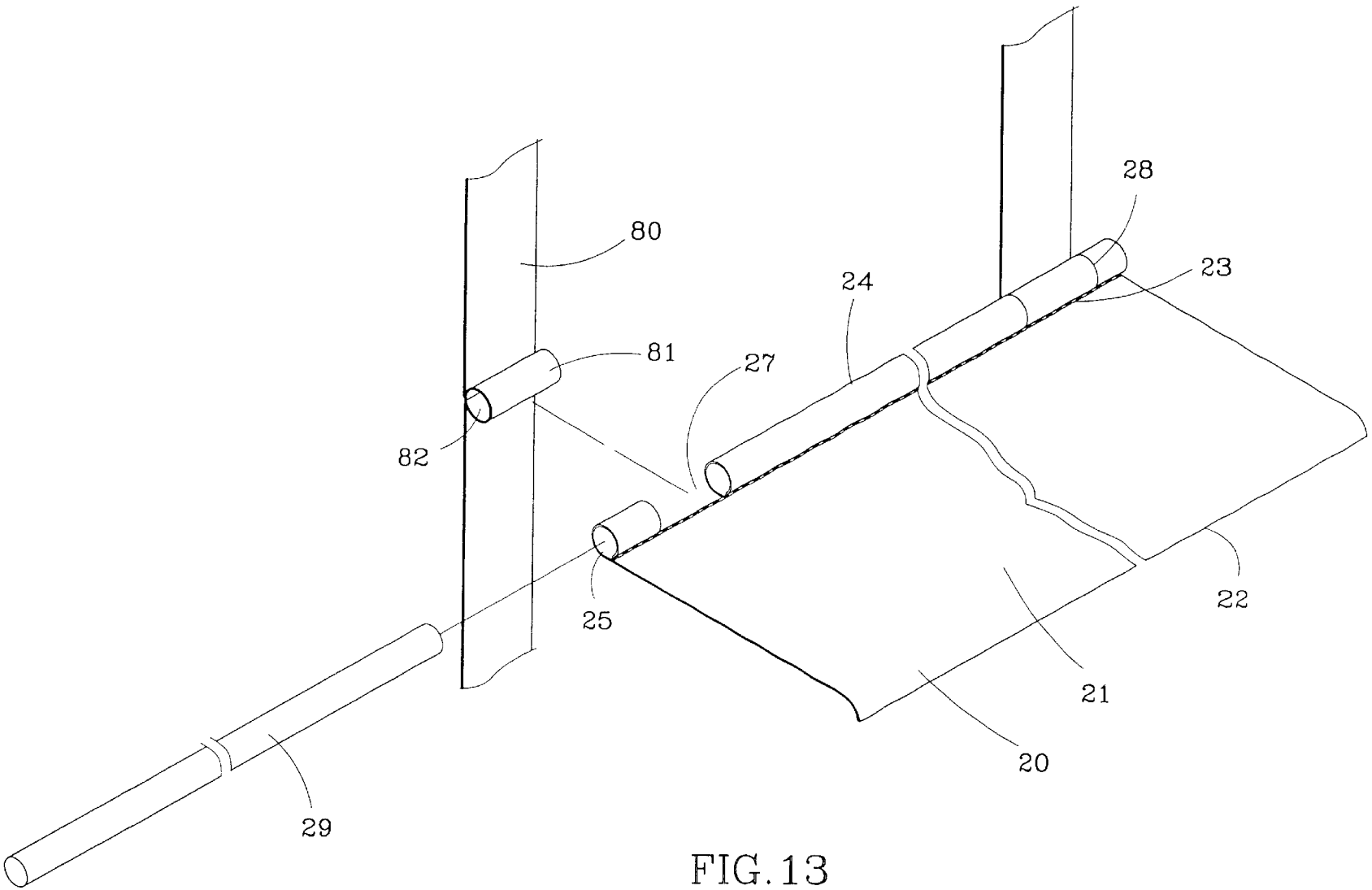
FIG. 13 is an exploded view in an enlarged scale of a part of a fifth embodiment of the present invention.

FIG. 13 is an exploded view of a part of the fifth preferred embodiment of the present invention. According to this embodiment, two belt-like connecting members 80 are used to join the vanes 20. Each belt-like connecting member 80 has plurality of transversely extended short sleeves 81 disposed at different elevations corresponding to the sleeves 24 at the second end portions 23 of the vanes 20, each short sleeve 81 defining a sleeve hole 82 for the insertion of a respective connecting rod 29. Further, the cut holes 27 and 28 of the sleeves 24 of the vanes 20 are made relatively longer than the aforesaid embodiments so as to receive the sleeves 81 of the belt-like connecting members 80.

Figure 14:
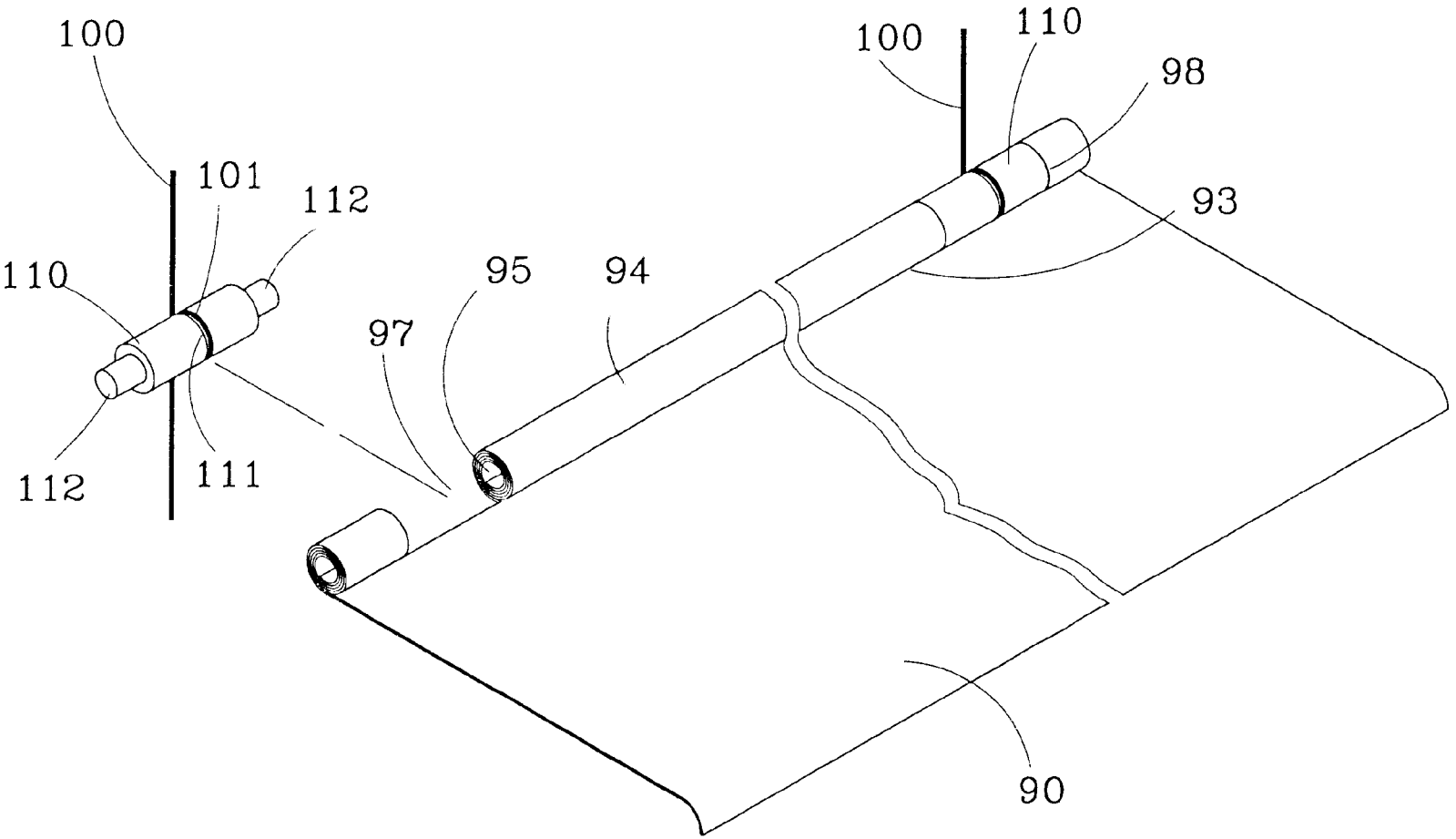
FIG. 14 is an exploded view in an enlarged scale of a part of a sixth embodiment of the present invention.

FIG. 14 is an exploded view of a part of the sixth preferred embodiment of the present invention. According to this embodiment, the second end portion 93 of each vane 90 is rolled up and glued, forming a sleeve 94 defining a sleeve hole 95. The sleeve 94 is properly cut, forming two cut holes 97 and 98. Two cord-like connecting members 100 are used to join the vanes 90. Each cord-like connecting member 100 has vertically spaced wire loops 101. Connecting rods 110 are respectively inserted into the wire loops 101 of the cord-like connecting members 100 and mounted in the cut holes 97 and 98 of the sleeves 94 of the vanes 90 to secure the cord-like connecting members 100 to the vanes 90. Each connecting rod 110 has an annular groove 111 around the periphery on the middle for the positioning of the corresponding wire loop 101, and two pins 112 respectively extended from the two ends thereof in reversed directions for inserting into the sleeve hole 95 of the sleeve 94 of one vane 90.

Figure 15:
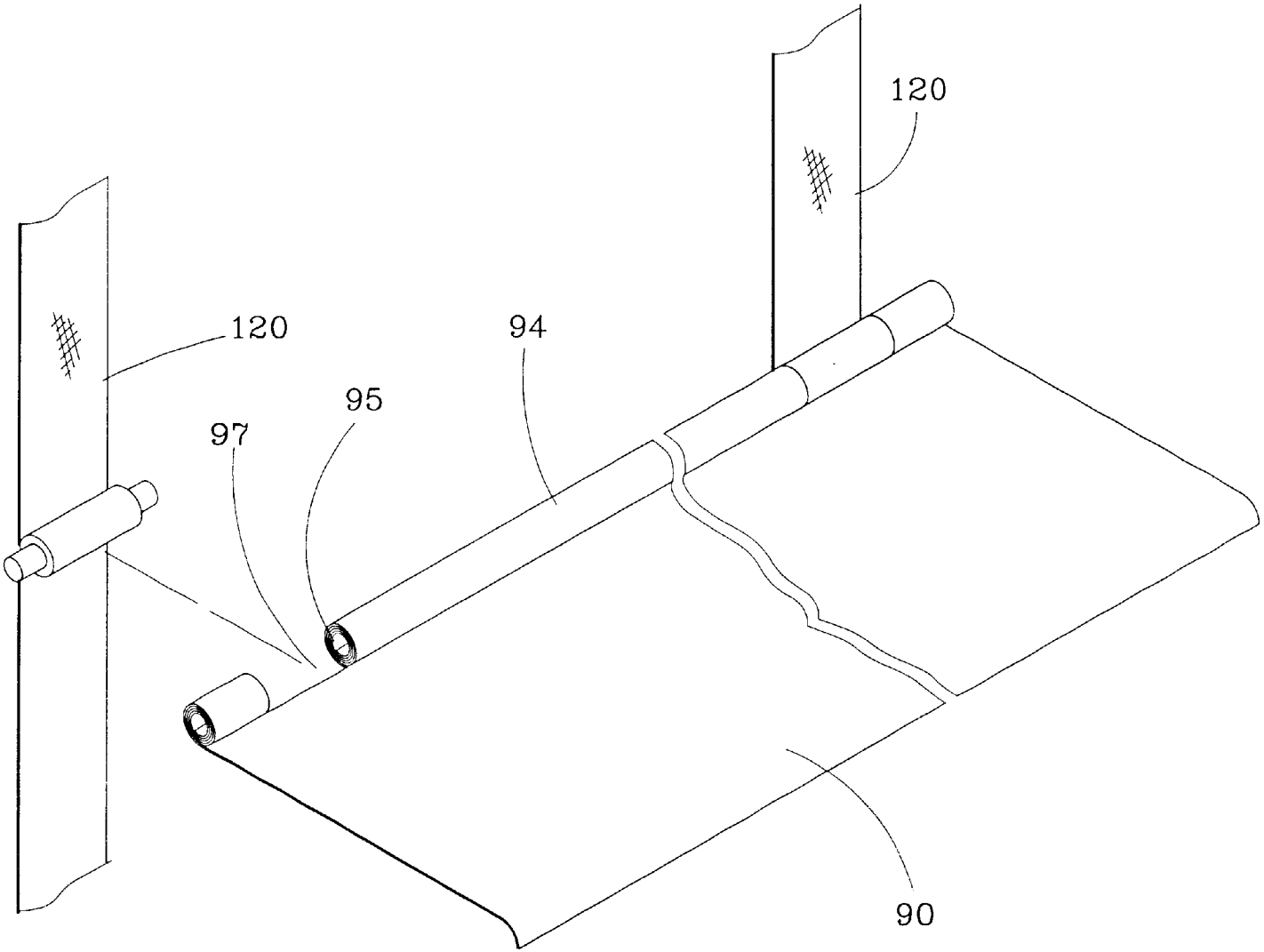
FIG. 15 is an exploded view in an enlarged scale of a part of a seventh embodiment of the present invention.

FIG. 15 is an exploded view of a part of the seventh preferred embodiment of the present invention. This embodiment is similar to the aforesaid sixth embodiment with the exception of the connecting members. According to this embodiment, the connecting members 120 are belt members.

Figure 16:
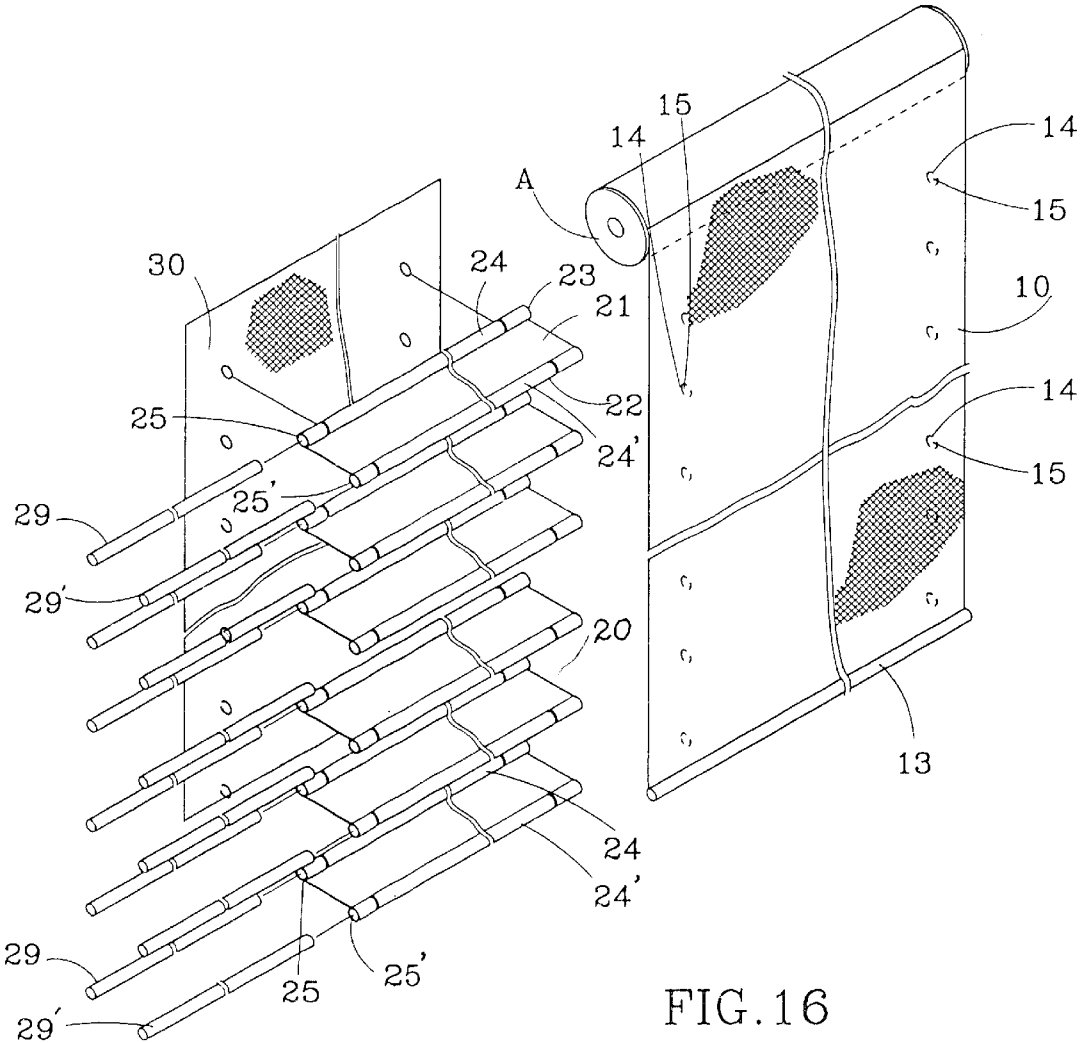
FIG. 16 is an exploded view in an enlarged scale of a part of an eighth embodiment of the present invention.

FIG. 16 is an exploded view of the eighth preferred embodiment of the present invention. According to this embodiment, the connection structure between the vanes 20 and the fabric sheet 10 is same as the connection structure between the vanes 20 and the connecting member 30, i.e., the fabric sheet 10 has pairs of wire loops 14 each defining a loop hole 15, and the first end portions 22 of the vanes 20 form a respective sleeve 24' defining a sleeve hole 25' for connecting to the wire loops 14 of the fabric sheet 10 by connecting rods 29'. According to this embodiment, the vanes 20 can be separated from the connecting member 30 and the fabric sheet 10 after removal of the connecting rods 29 and 29'. Therefore, the user can prepare different colors of vanes 20 for replacement when desired.

What is claimed is:

1. A light control window covering assembly comprising:

a fabric sheet made of translucent material;

a set of vanes made of opaque material, said vanes each having a first end portion and a second end portion, the first end portions of said vanes being connected to said fabric sheet at different elevations, the second end portions said vanes each providing with at least one first sleeve means each defining a first sleeve hole;

at least one connecting member arranged in parallel to said fabric sheet, said at least one connecting member each having a plurality of vertically spaced second sleeve means each defining a second sleeve hole corresponding in location to the first sleeve hole of the first sleeve means; and a plurality of connecting rods respectively inserted into the second sleeve holes of the second sleeve means of said at least one connecting member and the first sleeve holes of the first sleeve means of said vanes to secure said vanes to said at least one connecting member at different elevations.

2. The light control window covering assembly as claimed in claim 1, wherein the first sleeve mean at the second end portion of each of said vanes is comprised of an elongated sleeve having two cut holes near two distal ends thereof, the second sleeve means of said connecting member are wire loops respectively engaged into the cut holes of the elongated sleeve of each of said vanes for receiving said connecting rods.

3. The light control window covering assembly as claimed in claim 2 wherein the elongated sleeve at the second end portion of each of said vanes has two elastic bands at the two distal ends thereof around the respective sleeve hole.

4. The light control window covering assembly as claimed in claim 2 wherein the number of said at least one connecting member is 1, and the single connecting member is formed of a fabric sheet.

5. The light control window covering assembly as claimed in claim 2 where the number of said at least one connecting member is 2, and the two connecting members are respectively formed of a cord member.

6. The light control window covering assembly as claimed in claim 2 wherein the number of said at least one connecting member is 2, and the two connecting members are respectively formed of a belt member.

7. The light control window covering assembly as claimed in claim 1 wherein the second end portion of each of said vanes is rolled up and glued, forming the first sleeve means at the second end portion of the respective vanes.

8. The light control window covering assembly as claimed in claim 7 wherein the first sleeve mean of each of said vanes has at least one cut hole; the second sleeve hole of each of the second sleeve means of said connecting member is respectively sleeved onto said connecting rods; said connecting rods are respectively mounted in the at least one cut hole of the first sleeve means of each of said vanes.

9. The light control window covering assembly as claimed in claim 1 wherein the first sleeve mean of each of said vanes is formed of a wire loop; the second sleeve means of said connecting member each is formed of an elongated sleeve having at least one cut hole for receiving the wire loops of said vanes.

10. The light control window covering assembly as claimed in claim 9 wherein the number of said at least one connecting member is 1, and the single connecting member is formed of a fabric sheet.

11. The light control window covering assembly as claimed in claim 1 wherein said vanes each have at least one third sleeve means at the respective first end portion each defining a third sleeve hole that holes a respective connecting rod; said fabric sheet has a plurality of equally vertically spaced fourth sleeve means each defining a fourth sleeve hole for coupling to the connecting rods at the third sleeve means at the first end portions of said vanes to secure said vanes to said fabric sheet at different elevations.

12. A light control window covering assembly comprising:

a fabric sheet made of translucent material;

a set of vanes made of opaque material, said vanes each having a first end portion and a second end portion, the first end portions of said vanes being fixedly connected to said fabric sheet at different elevations, the second end portions of said vanes each providing with at least one wire loop each defining a loop hole;

a connecting member formed of a sheet of fabric material and arranged in parallel to said fabric sheet, said connecting member having at least two vertical rows of vertically extended elongated holes defining with the sheet of fabric material of said connecting member a plurality of transversely extended open sleeves at different elevations corresponding to said vanes; and a plurality of connecting rods respectively inserted into the open sleeves of said connecting member and the loop holes of the wire loops of said vanes to secure said vanes to said connecting member at different elevations.

* * * * *